US009429408B1

(12) United States Patent
Chamberlain et al.

(10) Patent No.: US 9,429,408 B1
(45) Date of Patent: Aug. 30, 2016

(54) COLLAPSIBLE CONTAINER FOR FLUID-JET GENERATION

(71) Applicant: Department of the Navy, Washington, DC (US)

(72) Inventors: Keith Chamberlain, Waldorf, MD (US); Angel Diaz, Waldorf, MD (US); Lee Foltz, Indian Head, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/756,650

(22) Filed: Sep. 29, 2015

(51) Int. Cl.

| | |
|---|---|
| ***F42D 5/045*** | (2006.01) |
| ***B65D 6/16*** | (2006.01) |
| ***B65D 6/18*** | (2006.01) |
| ***B65D 6/24*** | (2006.01) |

(52) U.S. Cl.
CPC ..... *F42D 5/045* (2013.01); *B65D 11/1846* (2013.01); *B65D 11/1866* (2013.01)

(58) Field of Classification Search
CPC ..... F42D 5/04; F41B 9/0043; F41B 9/0046; F41B 9/0078; F42B 33/062; F41H 11/12; F41H 11/32; A45F 3/20; A45F 2003/205; A47G 2019/2277; B65D 1/0292; B65D 7/28; B65D 9/18; B65D 11/11846; B65D 11/11866
USPC ..... 102/305, 306, 307; 86/50; 89/1.13, 89/1.25; 206/218, 577; 215/900; 222/630, 222/206
See application file for complete search history.

(56) References Cited

U.S. PATENT DOCUMENTS

| | | | | |
|---|---|---|---|---|
| 3,673,638 | A * | 7/1972 | Nordgren | B65D 9/18 217/12 A |
| 4,491,231 | A * | 1/1985 | Heggeland | B65D 11/1846 206/509 |
| 4,779,511 | A * | 10/1988 | Proctor | F42B 33/06 86/50 |
| 4,836,079 | A * | 6/1989 | Barrett | F42D 5/045 102/303 |
| 4,955,939 | A * | 9/1990 | Petrousky | F42B 12/10 102/306 |
| 4,957,027 | A * | 9/1990 | Cherry | F42B 33/062 86/50 |
| 5,562,221 | A * | 10/1996 | Beniacar | B65D 1/0292 215/12.1 |
| 5,936,184 | A * | 8/1999 | Majerus | F42B 3/08 102/306 |
| 5,970,841 | A * | 10/1999 | Trocino | F41H 11/14 89/1.13 |
| 6,269,725 | B1 | 8/2001 | Cherry | |
| 6,408,731 | B1 | 6/2002 | Elsener | |
| 6,532,875 | B1 * | 3/2003 | Schweitzer | F41H 11/12 102/402 |
| 6,584,908 | B2 | 7/2003 | Alford | |
| 7,954,433 | B1 | 6/2011 | Barnett | |
| 7,997,179 | B1 | 8/2011 | Nelson et al. | |
| 8,091,479 | B1 * | 1/2012 | Jakaboski | F42B 33/062 102/305 |

(Continued)

*Primary Examiner* — Bret Hayes
(74) *Attorney, Agent, or Firm* — Fredric J. Zimmerman

(57) ABSTRACT

A fluid-jet-generating container for a flowable material includes a one-piece open-ended body having eight sides and eight corners. Each of the eight corners is defined by a V-notch such that the open-ended body may define a collapsed state when the eight sides are disposed in two parallel planes, and may define a configured state with the eight sides arranged to define an open-ended U-shaped trough. End caps are sealed to the opposing ends of the open-ended body in its configured state.

21 Claims, 7 Drawing Sheets

(56) References Cited

U.S. PATENT DOCUMENTS

| | | | | |
|---|---|---|---|---|
| 8,276,495 | B1 | 10/2012 | Chiu et al. | |
| 8,677,902 | B1 | 3/2014 | Rock et al. | |
| 8,887,609 | B1 * | 11/2014 | Cherry | F42B 33/06 86/50 |
| 2006/0180614 | A1 * | 8/2006 | Barron | B65D 1/0292 222/210 |
| 2008/0017021 | A1 * | 1/2008 | Lacombe | F42D 5/045 89/36.02 |
| 2008/0257137 | A1 * | 10/2008 | James | F42D 5/045 86/50 |
| 2012/0216697 | A1 * | 8/2012 | Jacobsen | F41B 9/0093 102/439 |
| 2015/0053240 | A1 * | 2/2015 | Woodlock | A47J 47/02 134/22.1 |

* cited by examiner

COLLAPSIBLE CONTAINER FOR FLUID-JET GENERATION

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to containers used in the generation of a fluid jet when the container is exploded, and more particularly to a container that is collapsible to a flat configuration for ease of storage, handling, and transport until needed for use in a fluid-jet generation operation.

BACKGROUND OF THE INVENTION

Explosive ordnance disposal ("EOD") typically involves the use of specialized tools to safely disarm and/or explode ordnance or energetic threats in a safe manner. One such EOD tool uses an explosively-detonated container of water to create a water jet that accesses and disrupts components of energetic threats. Current water jet tools are bulky items that create storage and transportation issues, take a considerable amount of time to set up, and/or are relatively expensive.

SUMMARY OF THE INVENTION

Accordingly, it is an object of the present invention to provide a fluid-jet-generating container.

Another object of the present invention is to provide a fluid-jet-generating container that is collapsible for ease of storage and transport, and easily configured for use.

Other objects and advantages of the present invention will become more obvious hereinafter in the specification and drawings.

In accordance with the present invention, a fluid-jet-generating container for a flowable material includes a one-piece open-ended body having eight sides and eight corners. Each of the eight corners is defined by a V-notch such that the open-ended body may define a collapsed state when the eight sides are disposed in two parallel planes, and may define a configured state with the eight sides being arranged to define an open-ended U-shaped trough. A first end cap is sealed to a first end of the open-ended body in its configured state. A second end cap is sealed to a second end of the open-ended body in its configured state.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
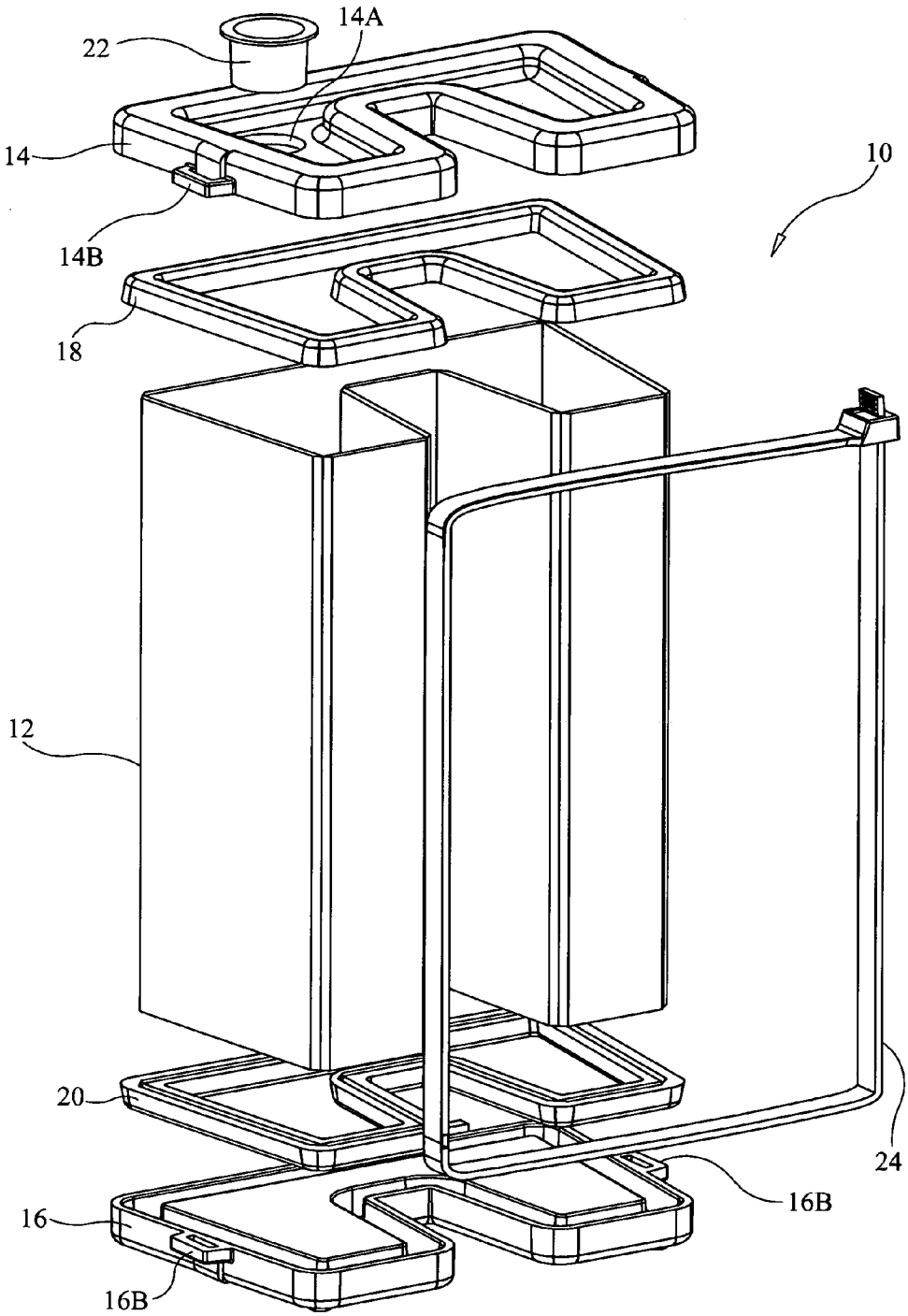
FIG. 1 is an exploded view of a collapsible fluid-jet-generating container in accordance with an embodiment of the present invention.

Referring now to the drawings and more particularly to FIG. 1, a fluid-jet-generating container in accordance with an exemplary embodiment of the present invention is shown in an exploded view and is referenced generally by numeral 10. When fully assembled for use, container 10 is filled with water or other fluid/flowable material (e.g., sand, dirt, a non-explosive liquid, etc.) that will form a penetrating jet of the flowable material when an explosive (not shown) coupled to container 10 is detonated.

Figure 4:
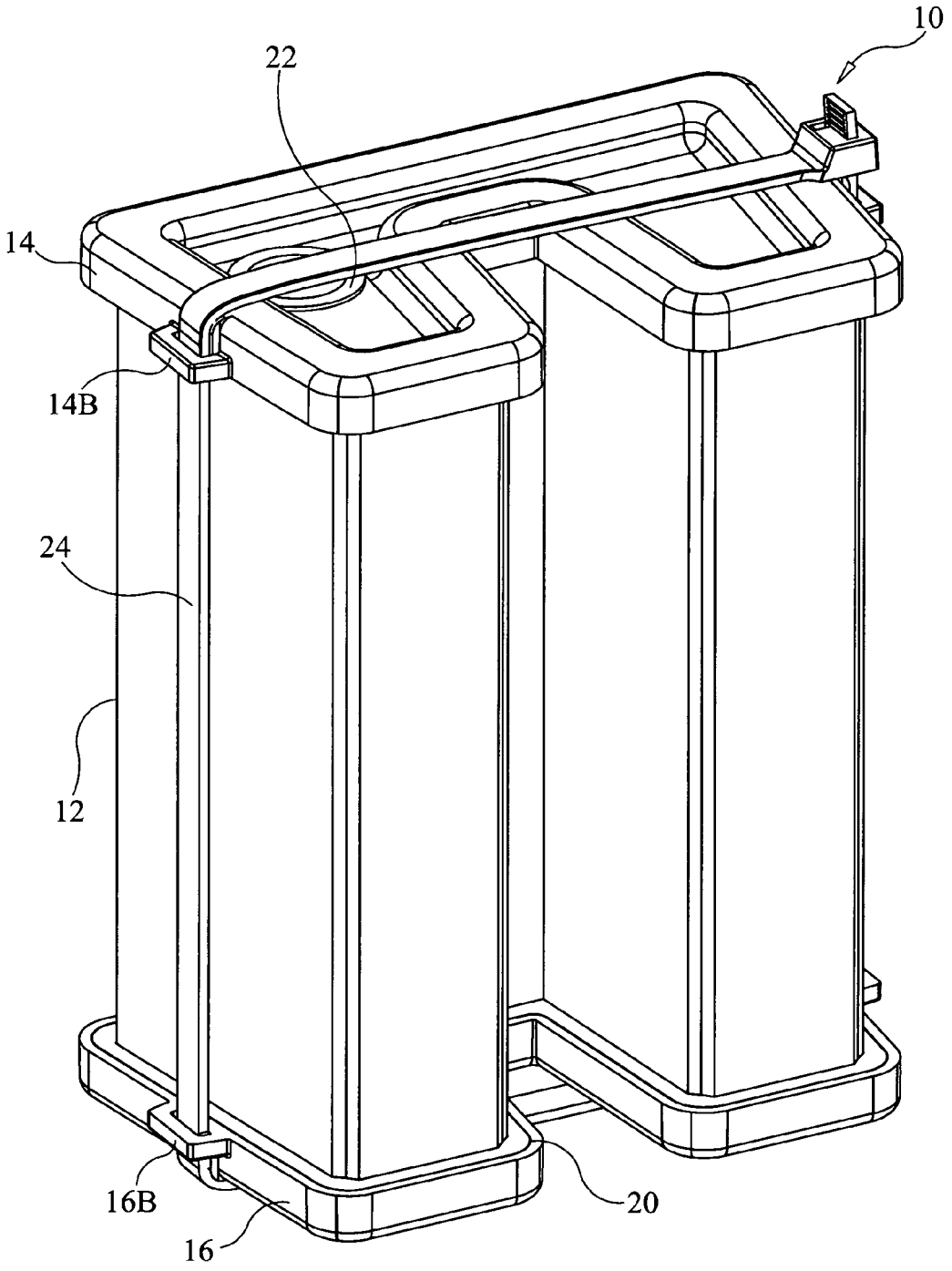
FIG. 4 is a perspective view of the container after being fully assembled in accordance with an embodiment of the present invention.

In the illustrated embodiment, container 10 includes an open-ended container body 12, end caps 14 and 16, gaskets 18 and 20, an access port sealing cap 22, and a tensioning strap 24. These elements are assembled into container 10 as shown in FIG. 4. Note that gasket 18 is not visible in FIG. 4 while only a portion of gasket 20 is visible in FIG. 4. In its assembled form, container 10 seals a flowable material therein (not shown).

Figure 2:
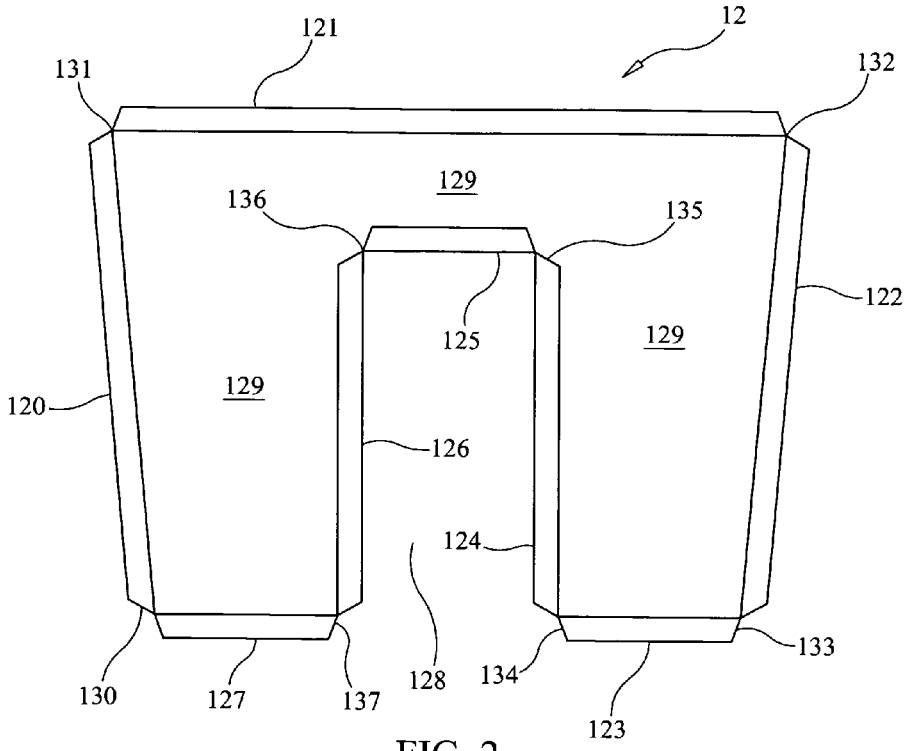
FIG. 2 is an isolated end view of the open-ended body portion of the container in its configured state.

Container body 12 defines the general shape of container 10. More specifically and with additional reference to FIG. 2 where a container body 12 is shown in an isolated end view thereof, container body 12 is a one-piece structure having eight sides 120-127 that are configured to define an open-ended U-shaped trough 128. Sides 124 and 126 form the side walls of trough 128 and side 125 forms the base of trough 128. The volume 129 defined by sides 120-127 is a continuous volume that is filled with a flowable material when container 10 is assembled.

Figure 3:
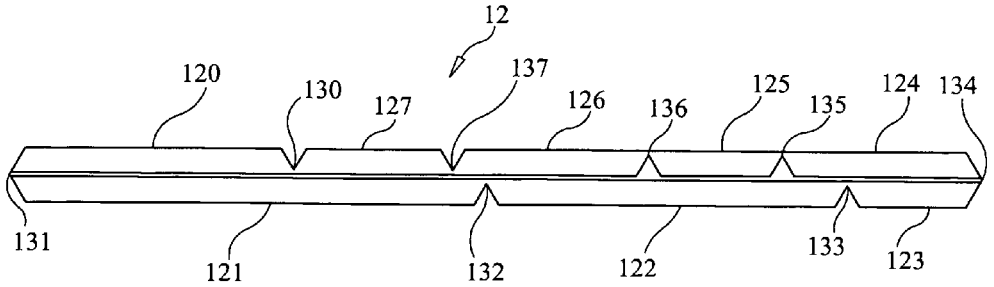
FIG. 3 is an isolated perspective view of the open-ended body portion of the container in its collapsed state.

While container body 12 in its configured state is an open-ended U-shaped trough, container body 12 also may be collapsed thereby greatly reducing the space needed to store/transport it to its use location. More specifically and with additional reference to FIG. 3, container body 12 may be collapsed such that sides 120-127 are disposed in two parallel planes. To provide container body 12 with this flexibility, adjacent ones of sides 120-127 are joined by an integrated hinge. For example, container body 12 may be made from a plastic material with each such integrated hinge being defined by a V-notch in the plastic material. In the illustrated example, V-notches 130-137 extend along the length of container body 12 to define the eight corners of container body 12. To support the flattened, collapsed state of container body 12 as well as the configured state of container body 12 in its open-ended U-shaped trough, V-notches 130-134 and 137 face away from volume 129 while V-notches 135 and 136 face into volume 129. The V-notches serve as integrated hinges that allow container body 12 to be configured to define corners that are approximately 90°. By being able to define corners that are approximately 90°, container body 12 supports the flattened/collapsed state and the configured state of the container body as well as supporting the transition between the two states. In this way, container body 12 is able to maintain an optimal shape during both storage and use thereof.

Figure 5:
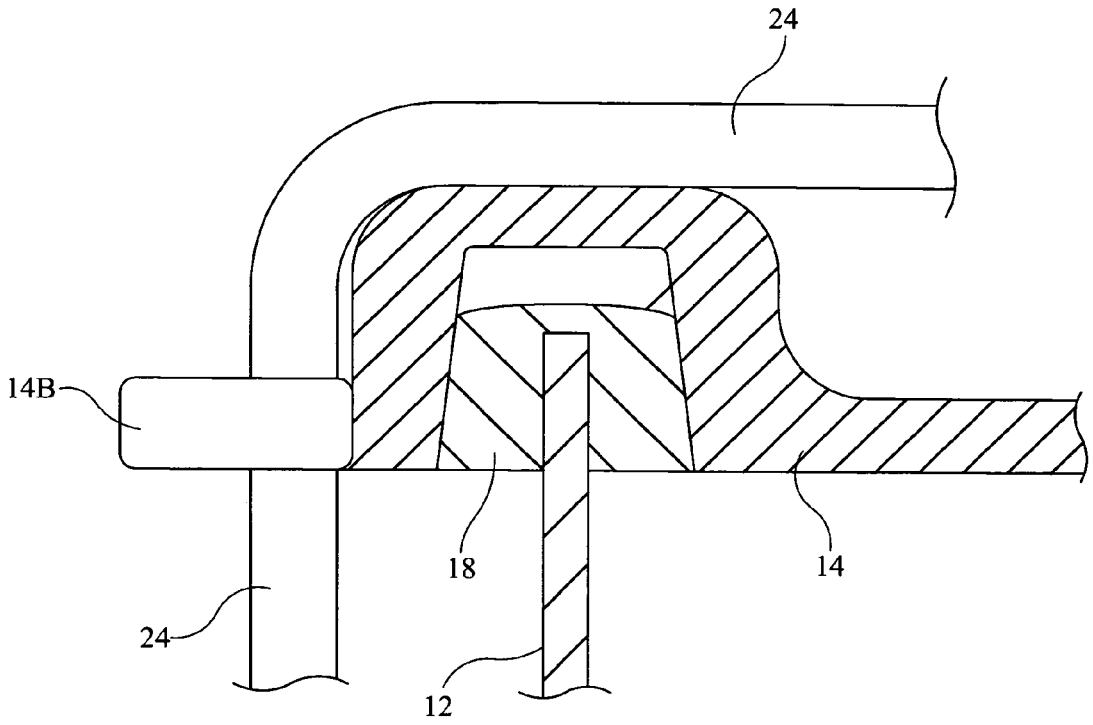
FIG. 5 is an enlarged cross-sectional view of a portion of the assembled container illustrating the relationship between the open-ended body, one gasket, and one end cap of the container.

Gaskets 18 and 20 are made from pliable material and are shaped to fit over the open ends of container body 12 in its configured state. End caps 14 and 16 are made from rigid materials (e.g., plastic) and include edges shaped to fit snugly over gaskets 18 and 20, respectively, and a respective end of container body 12. More specifically and with additional reference to FIG. 5 where a cross-sectional view of gasket 18 is visible on container 10 in its assembled state, gasket 18 fits over one end of container body 12 and forms a sealing fit with end cap 14. Such sealing gasket arrangements are well understood in the art. Accordingly, it is to be understood that the particular method of sealing end cap 14 to container body 12 is not a limitation of the present invention. Further, the sealing aspects of gasket 18 may be incorporated into end cap 14 without departing from the scope of the present invention. A similar construction and sealing arrangement may be used between the other end of container body 12 and the combination of gasket 20 and end cap 16.

An access port 14A may be defined in end cap 14 to facilitate the filling of container 10 with a flowable material. Cap 22 is used to seal port 14A. The access port and its sealing cap may additionally or alternatively be provided at end cap 16 without departing from the scope of the present invention.

Tensioning strap 24 wraps fully around end caps 14/16 and container body 12 to maintain the integrity of assembled container 10. In the illustrated exemplary embodiment, end caps 14 and 16 have eyelets 14B and 16B, respectively, through which tensioning strap 24 may be led. Strap 24 may be a simple "wire tie" or other type of adjustable strap without departing from the scope of the present invention.

Figure 6:
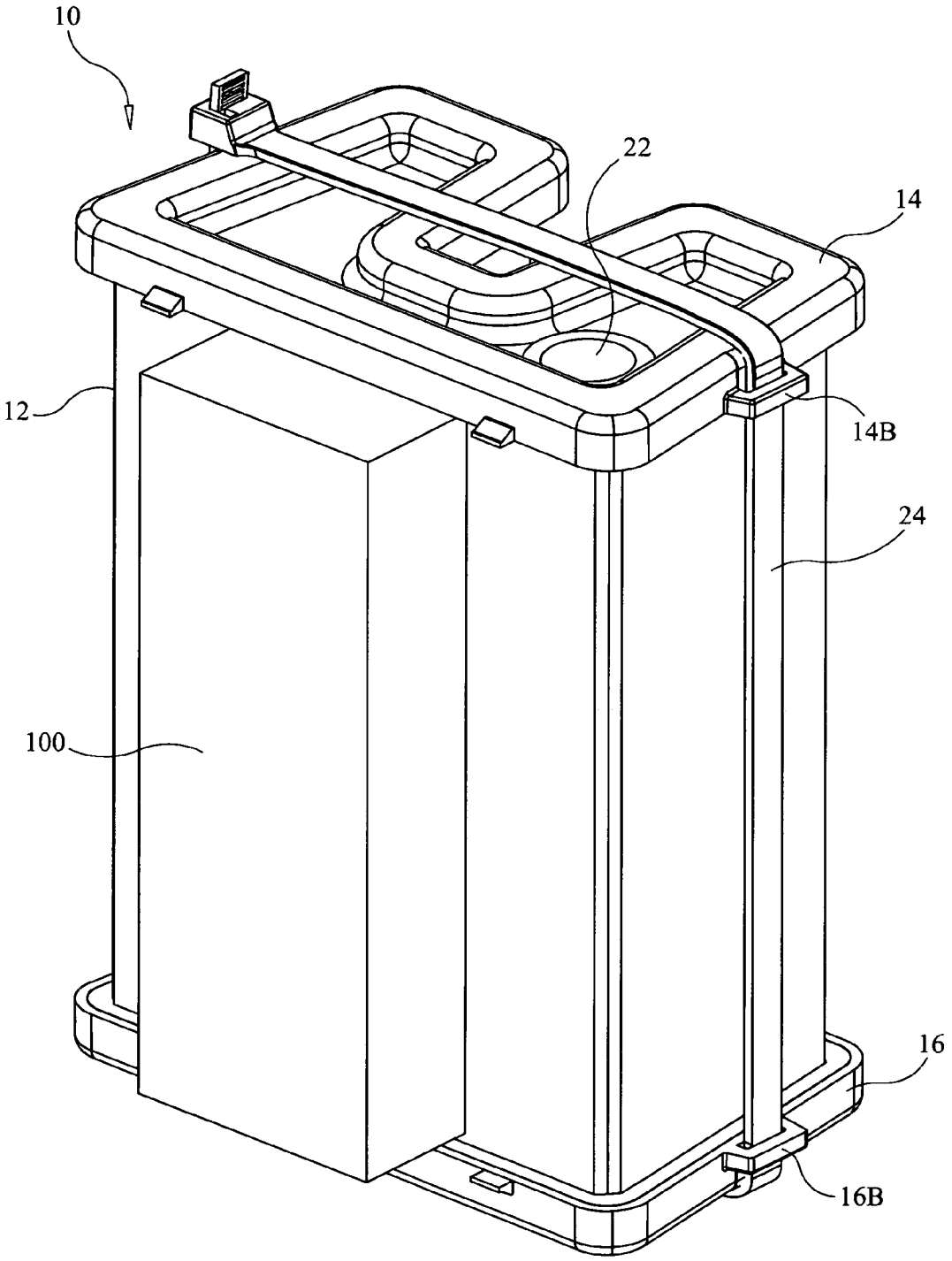
FIG. 6 is a perspective view of the container in its assembled form with an explosive coupled to a wall thereof.

In use, once container 10 is assembled (FIG. 4) and filled with a flowable material (e.g., water), an explosive 100 is attached/adhered to side 121 as shown in FIG. 6. Explosive 100 is aligned with the base (i.e., side 125) of trough 128. When container 10 is filled with a flowable material and explosive 100 is detonated, a high-powered jet of the flowable material is generated as is understood in the art.

Figure 7:
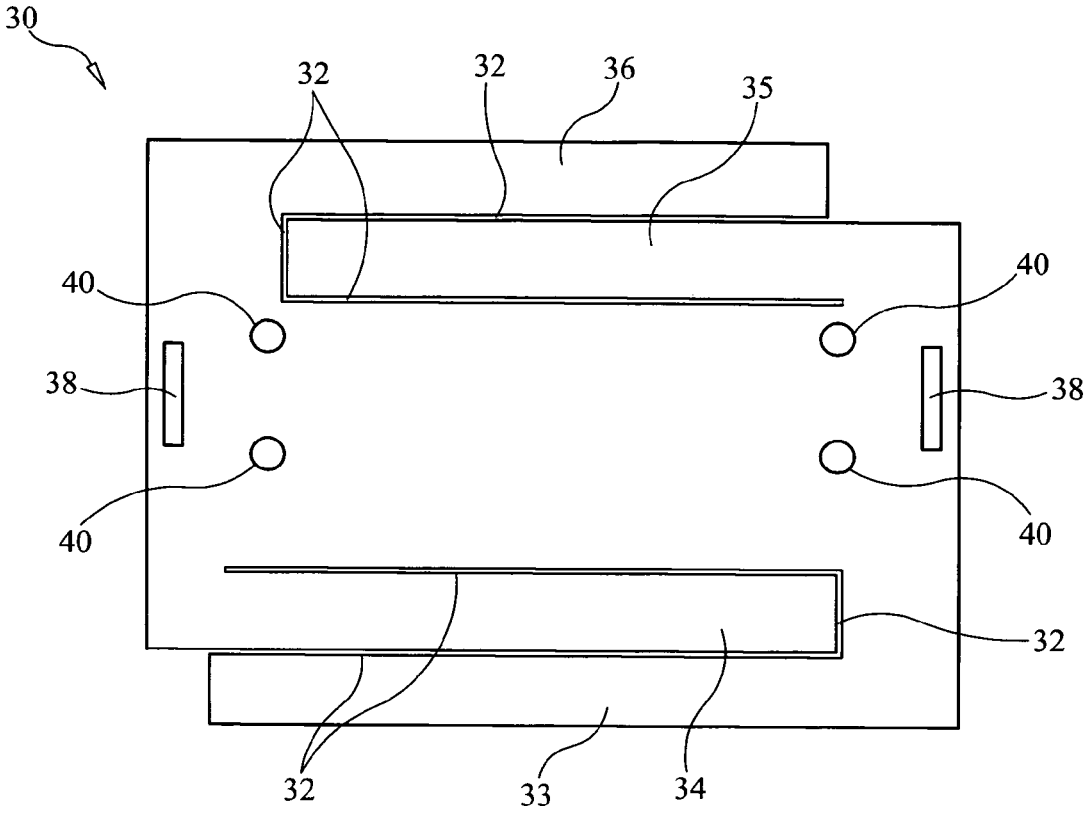
FIG. 7 is a plan view of a stand that can be configured to define four legs to support the container in accordance with an embodiment of the present invention.
Figure 8:
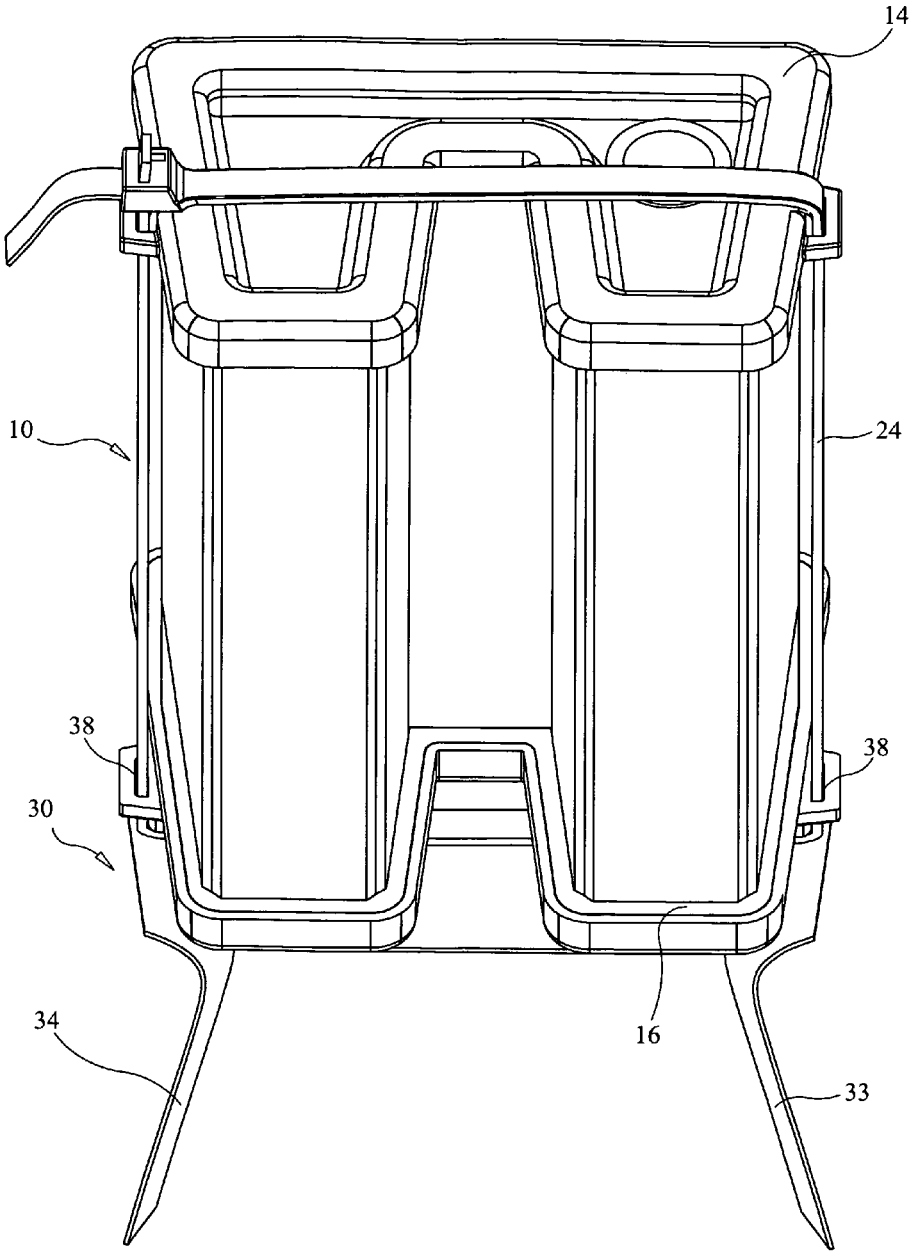
FIG. 8 is a side view of the assembled container strapped to the stand with the stand's legs bent to provide support in accordance with an embodiment of the present invention.

To help facilitate placement of the high-powered jet, the present invention may include an adjustable stand that can adjust the height and angle of container 10. To facilitate storage and transport of such a stand, it is desirable for the stand to be stored in a flat state similar to the collapsed state of container body 12. By way of example, one such stand is shown in FIG. 7 in its pre-use state and is referenced generally by numeral 30. In its pre-use state, stand 30 is a planar piece of sheet metal with score or cut lines 32 that define four strips 33-36 that may be bent to define legs of stand 30 as shown in FIG. 8 where only strips 33 and 34 in their bent configuration are visible. Eyelets 38 also may be defined to allow stand 30 to be coupled to container 10 by its tensioning strap 24. Holes or depressions 40 may be defined in stand 30 to index with tabs (not shown) on the end caps of container 10 in order to facilitate placement of container 10 on stand 30.

The advantages of the present invention are numerous. All elements of the fluid-jet-generating container are or can be placed in a relatively flat state for storage and transport. The container body is stored in a compact fashion and is readily configured and mated with sealing end caps just prior to being used. No tools are required for assembly.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A fluid-jet-generating container for a flowable material, comprising:

a one-piece open-ended body having eight sides and eight corners, each of said eight corners defined by a V-notch, said open-ended body defines a collapsed state wherein said eight sides are disposed in two parallel planes, and said open-ended body defines a configured state wherein said eight sides are arranged to define an open-ended U-shaped trough;

a first end cap being sealed to a first end of said open-ended body in said configured state; and a second end cap being sealed to a second end of said open-ended body in said configured state.

2. The fluid-jet-generating container as in claim 1 wherein, in said configured state, adjacent ones of said eight sides meet at an angle of about 90°.

3. The fluid-jet-generating container as in claim 1, further comprising:

an access port being defined in at least one of said first end cap and said second end cap; and a cap forming a sealed engagement with said access port.

4. The fluid-jet-generating container as in claim 1, further comprising a tensioning strap wrapping around said container, wherein said tensioning strap engages said first end cap and said second end cap to seal to said open-ended body in said configured state.

5. The fluid-jet-generating container as in claim 1, further comprising a stand for supporting said container when said open-ended body is in said configured state with said first end cap and said second end cap sealed thereto.

6. The fluid-jet-generating container as in claim 4, further comprising a stand supporting said container when said open-ended body is in said configured state with said first end cap and said second end cap sealed thereto, wherein said tensioning strap engages said stand.

7. The fluid-jet-generating container as in claim 5, wherein said stand comprises a sheet of a non-elastic material to define four bendable legs.

8. The fluid-jet-generating container as in claim 1, further comprising a first gasket being disposed between said first end of said open-ended body in said configured state and said first end cap; and a second gasket being disposed between said second end of said open-ended body in said configured state and said second end cap.

9. A fluid-jet-generating container for a flowable material, comprising:

a one-piece open-ended body including eight sides, adjacent ones of said eight sides being joined by an integrated hinge, wherein said open-ended body is collapsible to dispose said eight sides in two parallel planes and is configurable to define a configured state wherein said eight sides are arranged to define an open-ended U-shaped trough;

a first end cap being sealed to a first end of said open-ended body in said configured state; and a second end cap being sealed to a second end of said open-ended body in said configured state.

10. The fluid-jet-generating container as in claim 9 wherein, in said configured state, each of said adjacent ones of said eight sides meet at an angle of about 90°.

11. The fluid-jet-generating container as in claim 9, further comprising:

an access port being defined in at least one of said first end cap and said second end cap; and a cap forming a sealed engagement with said access port.

12. The fluid-jet-generating container as in claim 9, further comprising a tensioning strap wrapping around said container and engaging said first end cap and said second end cap sealed to said open-ended body in said configured state.

13. The fluid-jet-generating container as in claim 9, further comprising a stand supporting said container when said open-ended body is in said configured state with said first end cap and said second end cap being sealed thereto.

14. The fluid-jet-generating container as in claim 12, further comprising a stand supporting said container when said open-ended body is in said configured state with said first end cap and said second end cap being sealed thereto, wherein said tensioning strap engages said stand.

15. The fluid-jet-generating container as in claim 13, wherein said stand comprises a sheet of a non-elastic material defining four bendable legs.

16. The fluid-jet-generating container as in claim 9, further comprising a first gasket being disposed between said first end of said open-ended body in said configured state and said first end cap; and a second gasket being disposed between said second end of said open-ended body in said configured state and said second end cap.

17. A fluid-jet-generating container for a flowable material, comprising:

a one-piece open-ended body having eight sides, adjacent ones of said eight sides being joined by an integrated hinge, wherein said open-ended body is collapsible to dispose said eight sides in two parallel planes and is configurable to define a configured state, and wherein said eight sides are arranged to define an open-ended U-shaped trough with each of said adjacent ones of said eight sides meeting at an angle of about 90°;

a first end cap being sealed to a first end of said open-ended body in said configured state;

a second end cap being sealed to a second end of said open-ended body in said configured state; and a tensioning strap wrapping around said container and engaging said first end cap and said second end cap being sealed to said open-ended body in said configured state.

18. The fluid-jet-generating container as in claim 17, further comprising:

an access port being defined in at least one of said first end cap and said second end cap; and a cap forming a sealed engagement with said access port.

19. The fluid-jet-generating container as in claim 17, further comprising a stand for supporting said container when said open-ended body is in said configured state with said first end cap and said second end cap sealed thereto, wherein said tensioning strap further engages said stand.

20. The fluid-jet-generating container as in claim 19, wherein said stand comprises a sheet of a non-elastic material to define four bendable legs.

21. The fluid-jet-generating container as in claim 17, further comprising a first gasket being disposed between said first end of said open-ended body being in said configured state and said first end cap; and a second gasket being disposed between said second end of said open-ended body being in said configured state and said second end cap.

* * * * *